United States Patent [19]

Calboreanu

[11] Patent Number: 4,728,361

[45] Date of Patent: Mar. 1, 1988

[54] IRON ALLOYS, PROCESS AND APPARATUS FOR INTRODUCING HIGHLY REACTIVE METALS INTO MOLTEN METAL AND PROCESS AND PRODUCT FOR REMOVING IMPURITIES FROM MOLTEN METAL

[75] Inventor: George A. Calboreanu, Augusta, Ga.

[73] Assignee: G. I. W. Industries, Inc., Atlanta, Ga.

[21] Appl. No.: 922,244

[22] Filed: Oct. 23, 1986

Related U.S. Application Data

[62] Division of Ser. No. 756,417, Jul. 18, 1985, abandoned.

[51] Int. Cl.[4] ..... C21C 7/02

[52] U.S. Cl. ..... 75/53; 75/58

[58] Field of Search ..... 75/53, 58

[56] References Cited

U.S. PATENT DOCUMENTS

| | | | |
|---|---|---|---|
| 3,837,842 | 9/1974 | Tanoue | 75/58 |
| 3,917,240 | 11/1975 | Tanoue | 75/58 |
| 4,043,798 | 8/1977 | Nashiwa | 75/53 |

*Primary Examiner*—Peter D. Rosenberg

*Attorney, Agent, or Firm*—Newton, Hopkins & Ormsby

[57] ABSTRACT

Magnesium bullets are shot into molten Ferrous alloys in a ladle to react with oxygen and sulfur to form magnesium gas and slag. Boron and ferro-boron bullets are also employed with magnesium bullets. The resulting iron alloys have superior physical properties. The machine which discharges the bullets into the ladle includes a first solenoid actuated gate supporting the lowermost bullet in a column of additive bullets received in a tubular upright magazine of an air gun so as to release the bullets by gravity, one at a time, into the chamber of the air gun.

The air gun is disposed over a container of molten metal. A second solenoid actuated gate releasably supports the bullet in the chamber and a solenoid actuated valve in a compressed air line releases the air to drive the bullet down through the barrel of the gun and into molten metal. The angle of the counce can be varied. The arrangement is particularly useful for introducing magnesium into white iron and introducing boron into gray steel. Other metals can also be introduced in this fashion.

15 Claims, 14 Drawing Figures

IRON ALLOYS, PROCESS AND APPARATUS FOR INTRODUCING HIGHLY REACTIVE METALS INTO MOLTEN METAL AND PROCESS AND PRODUCT FOR REMOVING IMPURITIES FROM MOLTEN METAL

This is a divisional of co-pending application Ser. No. 06/756,417 filed on July 18, 1985, abandoned.

INTRODUCTION

This invention relates to a process and apparatus for introducing highly reactive metals into molten alloying metals and is more particularly concerned with boron alloys, an apparatus and process of producing white iron, ductile iron and steel by introducing into the molten alloy metal bullets made of reactive metal, such as magnesium or boron, to enhance the tensile strength, ductility, strain hardening and improved phase morphology of the resulting metal and reduce its impurities without adversely effecting other physical properties, such as its hardness and magnetic permability.

BACKGROUND OF THE INVENTION

The use of highly reactive metals, such as magnesium in the treatment of molten metal (ductile iron, white iron, steel etc.) has been limited because of the strong pyrotechnical reaction which accompanies the introduction of such reactive materials into the molten metal. Magnesium and/or boron are therefor difficult to introduce into molten metal.

At 1,600° C. the volume of 1 g of magnesium occupies 6.25 liters. At steel making temperatures the specific volume of magnesium vapor is 44,000 times the specific volume of molten steel.

This unfavorable specific volume factor for magnesium vapor to steel explains the extremely low solubility of magnesium in molten steel and generally in molten metal.

Also, at atmosphere pressure and 623° C., magnesium vapors ignite violently in the present of oxygen to form cubic crystals of MgO, seen as a white smoke.

The strong affinity of magnesium for oxygen and other elemental species, such as sulfur, which results from its thermodynamic characteristics, makes it an ideal treatment agent in molten metal for the removal of inclusions which, when present, are detrimental to the tensile properties of the solidified metal. Magnesium is also useful in reacting with silica ($SiO_2$) and maganese sulphate to remove these impurities by converting them to slag.

The intensity of the deoxidation reaction with magnesium in the molten metal is determined by the solubility of oxygen in the liquid. The solubility of oxygen in molten metal is a function of temperature according to the following equation:

$$\log [\%0] = -(6320/T) + 2.734$$

Where the temperature T is expressed in degree Kelvin.

Therefore at 1,400° C. the solubility of oxygen in molten metal is 0.019% and at 1,650° C. it is 0.276%.

Magnesium's capacity for oxygen removal is not limited to the elimination of oxygen dissolved in the metal but also acts to reduce metal oxides (FeO,MnO, etc.) thereby lowering the total oxygen content of the molten metal.

The solubility of magnesium is a function of temperature according to the equation.

$$\log \frac{\%\ Mg}{P_{Mg}} = 7.2 + \frac{11{,}838}{T}$$

Where P is the partial pressure of magnesium in kg per square centimeter and T the temperature expressed is in degrees Kelvin.

Due to the above considerations, and primarily because of its low solubility, it is very difficult to introduce enough magnesium, into molten ferrous alloys at the temperature of interest, for effective deoxidation, desulfurization and inclusion control.

The kinetics of the general deoxidation/desulfurization reaction in ferrous alloys using the injection procedure are determined by the following factors:

1. The specific rate based on the mechanism of reaction.
2. Contact time between injected species and the reacting species, solid or vapor, in the liquid alloy.
3. The degree of dispersion of the injected species in the molten alloy.
4. The efficiency and duration of the reactions as determined by the influence of slag, refractories and the atmosphere.
5. A very low chemical concentration gradient of dissolved sulfur and oxygen in the molten metal.

When magnesium is injected according to the present invention into molten ferrous metal, instantaneous vaporization occurs and a high volume of magnesium vapor is formed, which creates a turbulent stirring of the liquid and thereby creating convection inducted microdiffusion. Resulting from the magnesium injection treatment, a rapid and homogenization of the components in the molten metal will occur, favoring the kinetics of the deoxidation and desulfurization reaction.

The desulfurization process occurs at the interface between the magnesium vapor and the dissolved sulfur, and is enhanced by the higher surface activity of the sulfur in the vicinity of the vapor. At the interface between the vapor and the molten metal the ratio $A_S/a_{Fe}$ is several times higher than $a_S/a_{Fe}$ at locations remotes from the interface, where $a_S$ is the activity of the sulfur in the molten metal and $a_{Fe}$ is the activity of the molten iron.

The rate of removal of the solid reaction products (MgO, MgS) is determined by the difference in densities of the reaction products (2.8 gm/cm$^3$ for MgO) and the molten metal (7.3 gm/cm$^3$) and the viscosity of the molten metal.

The transport mechanism in turbulent flow (produced by magnesium injection according to the present invention), is more rapid than in the normal diffusion (non turbulent) process. The mass transport of the reacting increments to the effective interface is a component part of whole reaction process and may be the rate determining step.

To obtain the maximum deoxidation and desulfurization effect it is necessary to react the total amount of magnesium with the molten metal. Factors which enhance the total reaction are:

1. Maximum surface contact for reaction between magnesium and metal by formation of extremely small magnesium vapor bubbles.

2. Disrupted flow of magnesium vapor to increase both surface area (avoidance of piping effect) and exposure time.
3. Increase in total contact time between magnesium vapor and the molten metal achieved by increasing the penetration depth of the injected magnesium in the molten metal.
4. Increase in ferrostatic pressure by increasing the ladle height to diameter ration (also the increase in H/D causes more molten metal to be exposed a longer period of time to the magnesium vapors).

The present invention provides a unique combination of procedure and equipment to introduce into molten metal, preferrably and equipment to introduce into molten metal, preferrably nearly pure (50–100%) magnesium projectile (bullet) for the purpose of cleaning and refining the metal.

The amount of magnesium introduced into the molten metal is dependent on the specific alloy chemistry, the level of cleanliness required to attain superior mechanical properties and further the anticipated magnesium recovery.

A series of emperical tests have been performed on various grades of steel, ductile iron and white irons, to demonstrate the efficiency of the invention, favorable economic and the superior properties attained.

In carrying out the introduction of magnesium into the molten iron alloy materials, I employ a pneumatic gun which injects one or more bullets into the molten metal. Each bullet has a magnesium or ferro-magnesium body and pointed steel tip or nose with or without slots. The pneumatic gun is disposed over the molten metal in a container (ladle). The gun has a barrel, disposed along a vertical axis or at a prescribed angle to the surface of the molten metal so as to direct the bullet, containing additive metal, magnesium or boron for example, into the molten metal, at a velocity sufficient that the additive metal is submerged and progressively disintegrates and dissolved as it passes through the molten metal and the steel nose is thereafter melted and becomes a part of the molten alloy. The gun has a straight, upright, tubular magazine in which the bullets are stacked, end-to-end with the lowermost bullet being supported solely by a solenoid actuated gate, within the chamber of the gun. A second solenoid actuated gate in the breach of the barrel, received and supports a bullet in the chamber for discharge down the barrel.

Compressed air, fed through a pressure regulator and a solenoid valve, is introduced into the chamber as the barrel gate releases the bullet, so that the compressed air propels the bullet down the barrel, through the splash guard, and into the molten metal.

There are several embodiments of bullets which I have found suitable for use in the gun, one, a magnesium bullet is shown, having a cylindical body with a semi-spherical steel tip or nose. Another has a tapered steel tip or nose and still another a conical steel tip or nose. The sides of the nose and/or the body can have axially extending slots or grooves for guiding the bullet in its path through the molten metal and for providing increased reaction area.

Hollow, ingot carrying, bullets are also shown. These bullets have hollow cylindrical bodies with steel tips at both ends, the additives being confined within the body. Such bullets are used primiarily for introducing boron into molten metal. The body can be steel tubing, aluminum tubing copper tubing or the like.

The process of the invention includes producing bullets with pre-selected additive metal contained in each bullet and shooting one or more of these bullets preferably vertically into the molten metal in the ladle. The magnesium or boron which is introduced by such a procedure is thus progressively dissolved in the molten metal.

The boron addition, when shot beneath the surface of molten metal according to the above outlined procedure produces under cooling in the alloy which promotes smaller intricate crystals or carbides which produce superior tensile strength in white irons and steel.

OBJECT OF THE PRESENT INVENTION

It is the object of the present invention to produce white cast iron having characteristics of high wear resistance, high hardness as well as improved toughness, in some instances having improved plain strain fracture toughness.

Another object of the invention is to provide an effective means of introducing magnesium into the molten metal with optimum penetration and dispersion to achieve maximum deoxidation and desulfuration for improving tensile properties and toughness.

It is a further object of the invention to provide white cast iron having improved tensile strength, high hardness, improved elongation and improved wear resistance.

It is also an objective of the present invention to improve the dynamic impact and reduction of area for steels of various compositions keeping the same tensile strength, yield strength and elongation.

It is a further objective of the invention to provide a practical and inexpensive process for diminishing the total oxygen content of white iron and of steel.

It is also an object of the present inventions to diminish the hydrogen content to of steel alloys.

It is a further objective of the invention to change the shape and number of non-metallic inclusions providing a quality between class III and IV SEP (German Cleanliness Standard).

It is also an objective of the invention to avoid segregated areas in castings or ingots.

It is a further objective of the present invention to obtain for non-alloyed steel, an austenetic grain size of about class 5–8 per ASTM specification.

Another object of the present invention to provide an inexpensive and efficient method an apparatus for introducing additives metals into molten metal.

Another object to the present invention is to provide a method by which a measured quantity of an additive metal can be introduced to a molten metal in a container.

Another object to the present invention is to provide a process by which an improved white cast iron can be produced, using boron.

Other objects features and advantages of the present invention will become apparent from the following description, when taken in conjunction with the accompanying drawing wherein like characters of reference designate corresponding parts throughout the several views.

DETAILED DESCRIPTION

Figure 1:
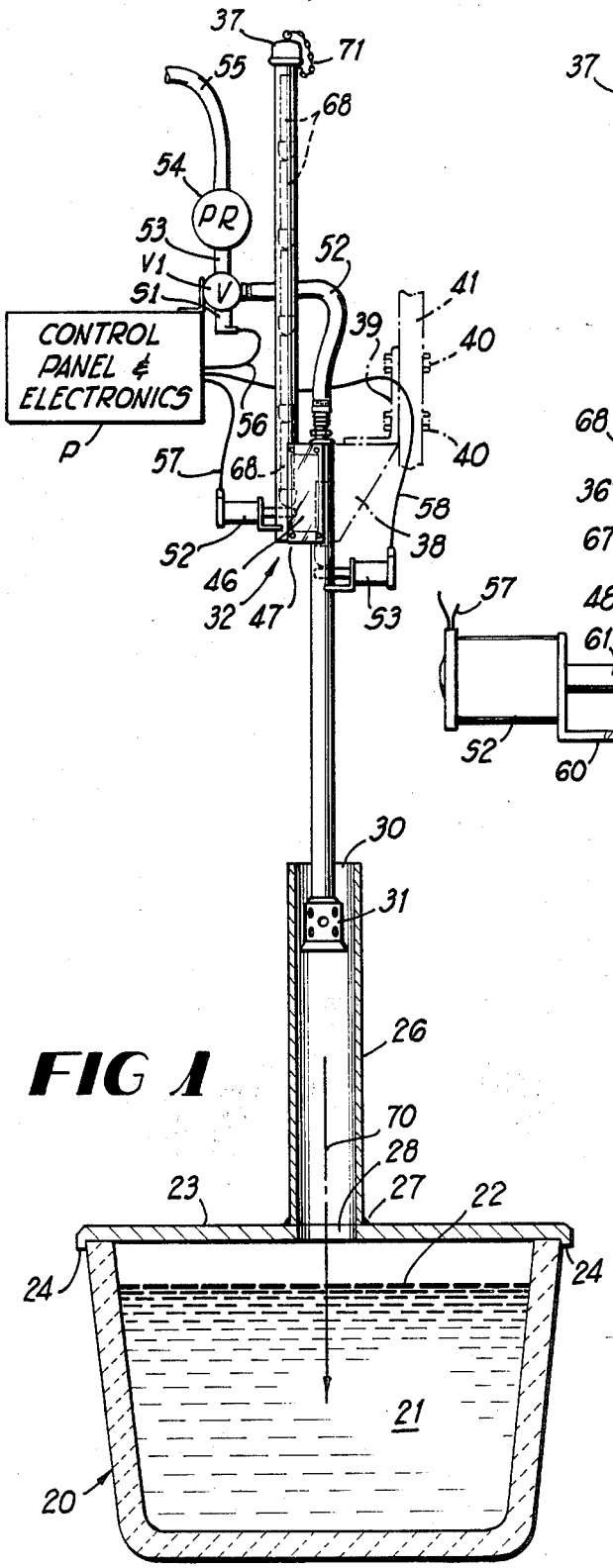
FIG. 1 is a side elevational view, partially broken away, showing an apparatus for introducing additive metals into molten metals, constructed in accordance with the present invention, the bullets used therein being shown in broken lines.

Referring now in detail to the embodiments chosen for the purpose of illustrating the present invention, numeral 20 in FIG. 1 denotes a molten metal container, such as a ladle, which contains molten metal 21 therein. Numeral 22 denotes the upper surface of the molten metal 21.

Disposed on the top of the ladle 20 is a splash plate 23 which is a flat member having opposed downwardly protruding flanges 24 at its ends, the plate 23 being sufficiently wide that the flanges 24 overlap the outer edge portions of the ladle 20 on which the plate 23 is placed, as depicted in FIG. 1. to arrest lateral movement of the plate 23. The central portion of the plate 23 is provided with an upstanding hollow cylindrical barrel receiving member 26, the lower end of which is secured by weld 27 to the upper surface of plate 23 in a position aligned with a circular hole 28 in plate 23. The upper end 30 of receiving member 26 is open and is adapted to receive the alignment head 31 of the pneumatic gun, denoted generally by the numeral 32. This pneumatic gun 32 has a straight hollow cylindrical barrel 33 which carries, at its lower or discharge end, the barrel alignment head 31. Barrel 33 has an inside bore 34 which is of a diameter slightly greater than the diameter of the bullet, such as bullet 68, which is to be discharged by the gun 32 into metal 21. At the upper end of breach portion of the barrel 33 is a chamber denoted generally by the numeral 35. This chamber 35 forms an airtight junction between the breach end of barrel 33 and the discharge end of the magazine 36.

As shown in FIG. 1, the gun 32 is supported preferably in an upright position by a bracket plate 38 carried by a crossbeam 39 mounted by bolts 40 to a vertical support beam 41.

When barrel 34 is disposed vertically, the magazine 36 is also disposed vertically and in any event is offset sidewise from the barrel 33. Chamber 35 including rear plate 45 and a removeable transparent front plate 46, the front plate being disposed generally parallel to and forwardly of the rear plate 45. The front plate 46 is a rectangular member held in place on the remainder of the magazine 36 by machine screws 47, seen in FIG. 1. The opposed sides 48 and 49 of the chamber 35 are respectively concaved extensions of the outer halves of the end portions of magazine 36 and the barrel 33, respectively.

At the upper end portion of the chamber 35 is a cylindrical plug 50 to which is threadedly attached a pneumatic or air nozzle 51 connected to the discharge end of an air hose 52. As seen in FIG. 1, the other end of the air hose 52 is connected to the discharge side of a solenoid controlled valve V 1 which has an intake, connected to a pipe 53. Pipe 53 leads from a pressure regulator 54 connected by hose 55 to a source of compressed air. The valve V 1 is controlled by solenoid S 1 which is electrically connected to a controlled panel P by wires 56.

A second solenoid S 2 is connected by wires 57 to the controlled panel P and a third solenoid S 3 is connected by wires 58 top panel P. An L-shaped bracket 60, mounted on the side 48 of the chamber 35, supports solenoid S 2. Protruding from the solenoid S 2, in essentially horizontal position is a gate bar 61 which is a rigid-member which extends through an appropriate hole in side 48 to terminate in the central portion of the chamber 35. Gate bar 61 serves a double function of arresting the bottommost bullet 68 in the stack to a height sufficient for the upper end of bullet 68 to remain in the end portion of magazine 36 then release that bullet 68 when gate bar 61 is retracted and secondly to that bullet 68 when gate bar 61 is retracted and secondly to push the side of bullet 68 to urge the bullet to an upright after the spring of solenoid S 2 returns it to its extended position.

The solenoid S 3 is mounted by an L-shaped bracket 62 to the side of the barrel 33. Solenoid 53 actuates an inwardly protruding horizontal gate bar 64 having a rounded end. Gate bar 64 protrudes through a hole in the breach portion of barrel 33.

Figure 2:
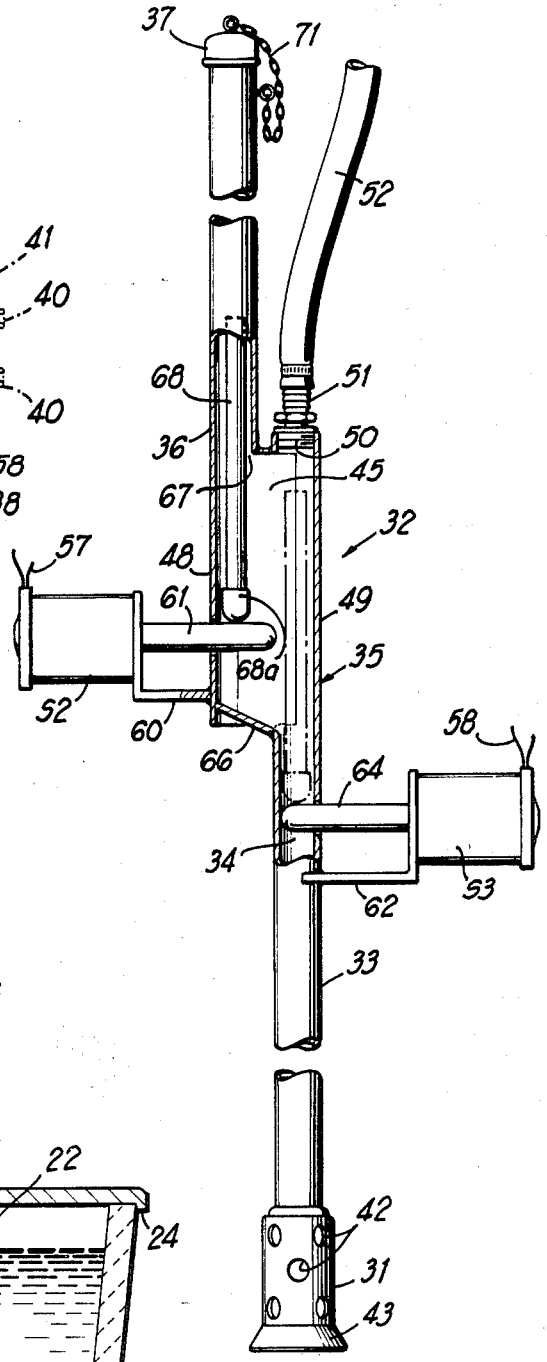
FIG. 2 is an enlarged side elevational view of the gun of the apparatus shown in FIG. 1, a portion of the chamber of the gun being broken away to illustrate the interior of the chamber of the gun.

The solenoids S 2 and S 3 are spring return solenoids which normally position the gate bars 61 and 64 in their extended positions shown in FIG. 2. When solenoid S 2 is energized, it retracts the gate bar 61 to a retracted position and when solenoid S 3 is energized it retracts the gate bar 64 to a retracted position. The bottom of the chamber 34 is provided with a flat side plate 66 which is disposed below the gate bar 61 and is an incline toward and terminates at the breach of barrel 33.

The distance between the gate bar 61 and mouth 67 of magazine 36 is less than the length of a bullet 68 and, therefore when a bullet 68 is placed in the upper end of the magazine 36, it will fall down the magazine 36 and rest with its lower end on the gate bar 61 and its upper end portion within the magazine 36. Subsequent bullets 68 can be loaded in the magazine 36 end to end until the magazine 36 is filled.

The upper end portion of the magazine 36 is externally threaded and receives an internally threaded cap 37 thereon. A chain 71 connects cap 37 and the upper portion of the magazine 36 to retain the cap 37 when the cap 37 is removed from the end of the magazine 36.

Figure 3:
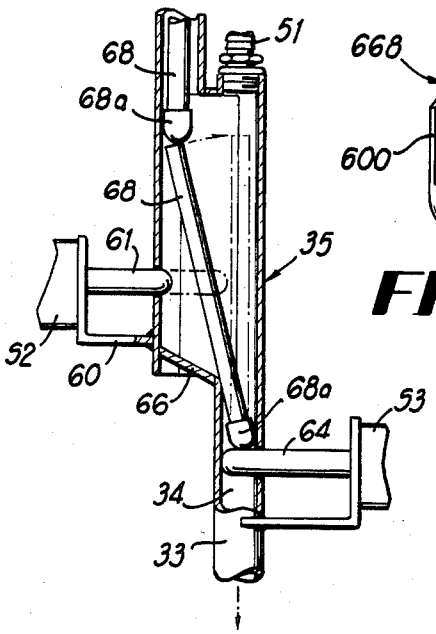
FIG. 3 is a fragmentary side elevational view, partially broken away, of the chamber portion of the gun depicted in FIGS. 1 and 2.

When the solenoid S 2 is energized, the gate bar 61 is retracted from an extended position, shown by broken lines in FIG. 3, to a retracted position shown by the full lines in FIG. 3. Thus, the lowermost bullet 68 will fall by gravity downwardly with the tip 68*a* of the bullet 68 being deflected sidewize by plate 66 to the breach portion of the barrel bore 34. The bullet 68 continues to fall downwardly until the tip 68*a* is received on, and the downward movement of the bullet 68 arrested by, the gate bar 64. The bullet 68 is thus disposed angularly or at an incline in the chamber 35, as shown in FIG. 3

When the solenoid S 2 is de-energized, the gate bar 61 of the solenoid S 2 is returned by spring action to the position shown by broken lines in FIG. 3, thereby engaging the body of bullet 68 and pivots the bullet 68 to an upright position, aligned with bore 34. The distance from gate bar 64 to the air inlet nozzle 51 is slightly greater than the length of the bullet 68 and, hence, the bullet 68 sits in an upright position below nozzel 51 in a position to be discharged downwardly through barrel 33. The bullet 68 (which has a tip 68*a* resting on the butt end of lowermost bullet 68) is released by the bullet 68 and falls downwardly until it is arrested by the gate bar 61.

It is preferable to arrange the solenoid S 1 and S 3 in parallel and control both through a switch (not shown) in the control panel P so that the solenoid S 1 and S 3 are simultaneously energized and de-energized. Thus, when solenoid S 3 is energized, to retract gate bar 64, solenoid S 1 is energized to open valve V 1 to release compressed air through hose 52 and nozzle 51 into the chamber 35. Hence, since the chamber 35 is closed and the magazine 36 is essentially closed by cap 37, substantially all of the air under pressure is discharged downwardly through the bore 34 and emerges out of the holes 42 in the peripheral of the head 31 at the lower end of the barrel 33. The head 34, as seen in FIG. 1, is received in the upper portion of the barrel receiving member 26 and has a annular flaring plate 43 at its lower end portion. Annular plate 43 presents the compressed air passing out of holes 42 from passing downwardly through the member 26.

The bullet 68 thus is propelled, in the path of the arrow 70 in FIG. 1, into the molten metal 21 where the reactive part of the bullet 68 is progressively dissolved in the molten metal beneath the surface 22 and its steel nose 68*a* becomes part of the molten metal 21. Additional bullets, such as bullet 68, can fired in succession, quite rapidly, if desired, so as to charge a prescribed number of bullets 68, into the molten metal 21.

The shape of the bullets, such bullet 68, is significant in determining the depth of penetration. In FIGS. 4 through 7 several forms of magnesium bullets are illustrated. In FIG. 4, the bullet 68 which is of the type illustrated in FIGS. 1, 2 and 3, is shown, having a solid straight ferro-magnesium, cylindrical rod forming body 68*b*. The ends 68*c* and 68*d* of body 68 are flat and in radical planes. The tip or nose 68*a* is provided on its rear side with a cylindrical recess which receives the lower portion of body 68*b*. The lower portion of body 68*b* can be frictionally held in the recess of nose 68*a* and indeed can be cast in place, if desired. A cross pin 68*e* which passes radically through the upper end portion of the tip 68*a* and the lower end portion of the body 68*b* fixes the two members together, the lower end portion of the body 68*b* protruding a short distance into the recess of the tip 68*a*, as illustrated in FIG. 4. The lower end portion of tip 68*a* is tapered outwardly to provide a semi-spherical end, as indicated in numeral 68*f*. The tip 68*a* is a mechanical steel member which does not readily erode upon a striking the surface of the molten metal 21. Therefore, tip 68*a* creates a path of travel along which it pulls the magnesium rod or body 68*b* as they dissolve. The diameter of tip 68*a* is larger than the diameter of body 68*b* for creating that path of trajectory.

Figure 4A:
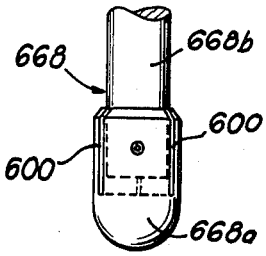
FIG. 4A is a view similar to FIG. 4 but showing a modified form of the bullet.
Figure 4:
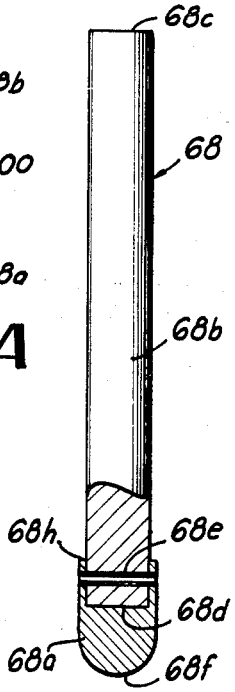
FIG. 4 is a side elevational view, partially broken away showing one form of bullet which is utilized in the apparatus depicted in FIG. 1.

In FIG. 4A is a modified form of bullet in which the nose 668*a* has four outwardly opening circumferentially spaces, axially disposed, grooves 600 which extend from an intermediate position of nose 668*a* rearwardly to the rear end of the nose 668*a*. The grooves 600 communication with the surface of the magnesium rod or body 668*b* within the recess of the nose and thus expose an increased area of contact for the magnesium to the molten metal. Grooves 600 also serve to guide the bullet 668 in its path.

Figure 5:
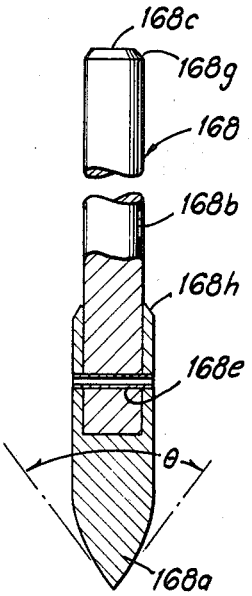
FIG. 5 is a side elevational view, partially broken away, showing an alternate form of bullet utilized in a apparatus depicted in FIG. 1.

In FIG. 5 is seen that, if desired, the body 168*b* of bullet 168 can be provided with an end 168*c* which has a bevelled edge 168*g* so as to taper upwardly at the upper end portion of the body 168*b*. The lower portion of the rod or body 168*b*, in the embodiment of FIG. 5 is received within the upper half of a tip 168*a*. The lower end of tip 168*a* is convex and tapers at angle $\alpha$ to a point, as illustrated in FIG. 5. A transverse pin 168*e* similar to pin 68*e* retains the lower end portion of the rod or body 168*b* embedded in the cup shape recess in the upper end of the tip 168*a*.

Figure 6:
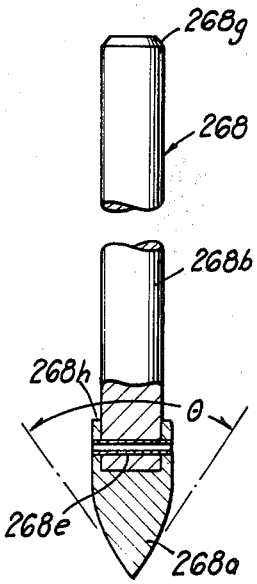
FIGS. 6 and 7 are views similary to FIG. 5 and showing still alternate bullets which can be utilized in the structure depicted in the apparatus depicted in FIG. 7.

In FIG. 6, it is seen that the tip 268*a* of bullet 268 can be substantially shorter than the tip 168*a*, if desired. Thus, the body 268*b* will be recessed only to a limited extent within the cup formed at the upper end of the tip 268*a*. Tip 268*a* and body 268*b* are retained together by the pin 268*e*.

The upper end portion of the tips shown in FIGS. 4 and 6 have radically flat surfaces 68*h* and 268*h*.

Figure 7:
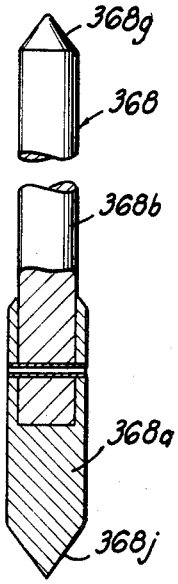
Figure 8:
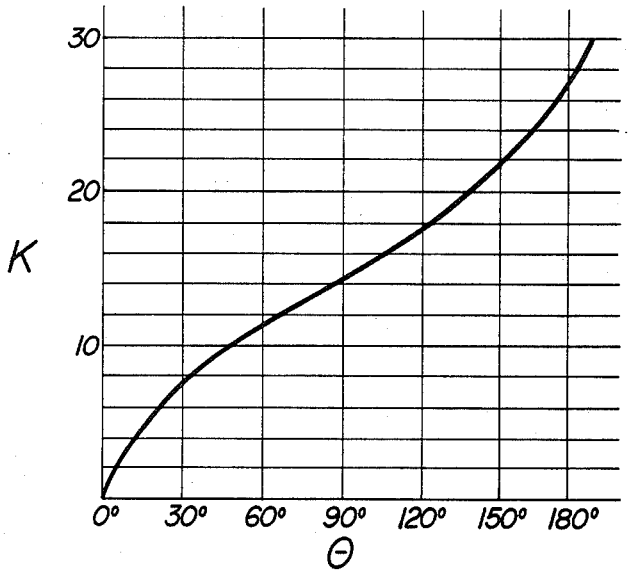
FIG. 8 is a graph of the nose angle $\alpha$ of the bullet versus the geometrical factor K of the bullet.
Figure 9:
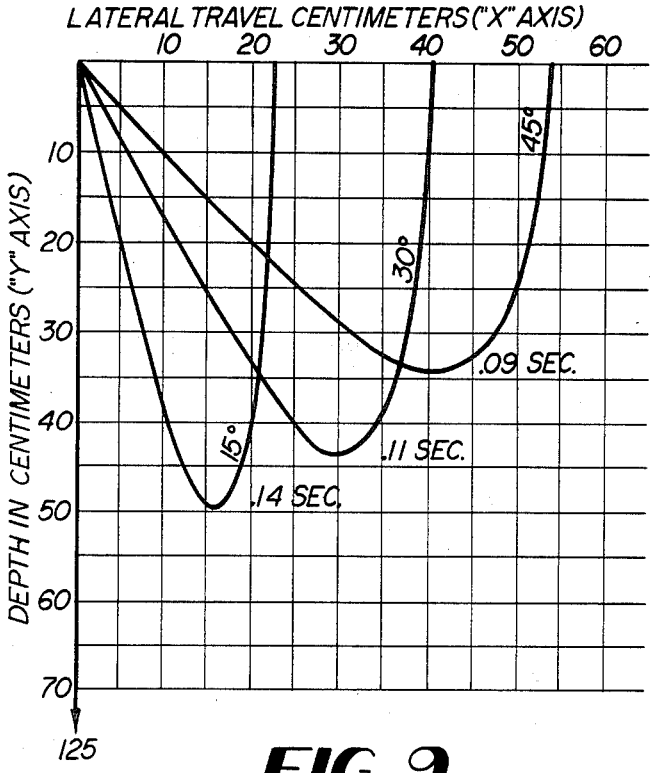
FIG. 9 is a graph of the theoretical trajectory of entry of the bullet into the molten metal at selected angles of penetration.

Referring now to FIG. 7, further streamlining is shown for bullet 368 in which the butt end of the magnesium rod or body 368*b* is cone shaped, tapering to a point at its rear or upper extremity. The nose or tip 368*a* is cylindrical in its central portion but has a cone shaped lower extremity, which tapers outwardly as denoted by the numeral 368*j*.

Figure 10:
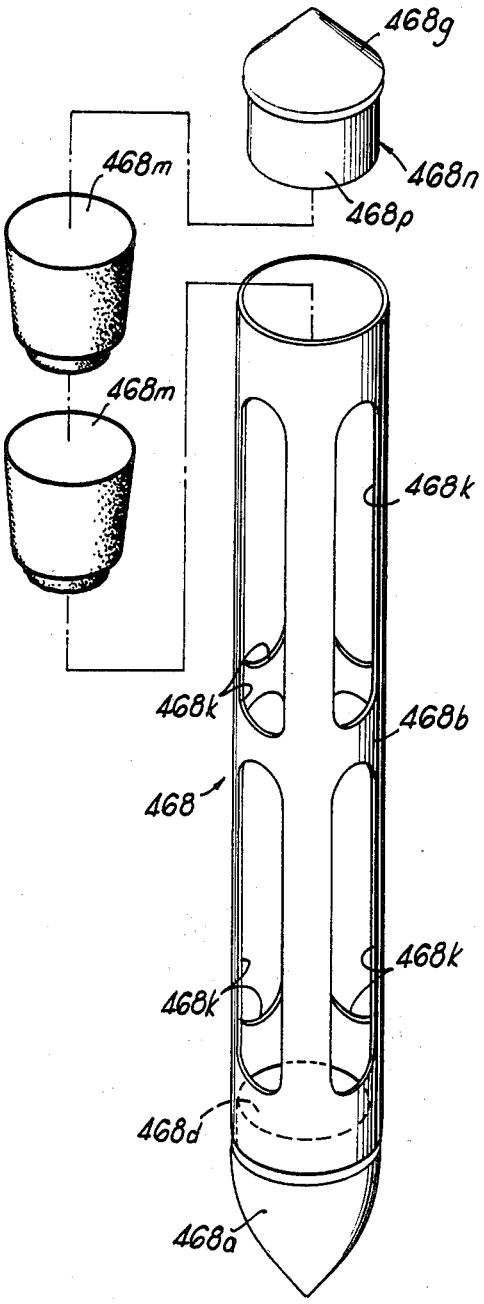
FIG. 10 is a perspective view of still another alternate form of bullet which can be utilized in the apparatus depicted in FIG. 1.

In FIG. 10, it is seen that, for additives which disintegrate readily, such as boron. "OPTIGRAN*" "GERMANLLOY" calcium salt (NaCl), "MISHMETAL*", etc. The body 468*b* of the bullet 468 is formed as a hollow cylindrical tubular member which is of aluminum and which is provided with circumferentially spaced and longitudinally spaced openings 468*k*. Preferably the openings are elongated along the axis of the bullet 468 and arranged in circumferentially spaced relationship in groups of four openings.

*OPTIGRAN is a trademark for an additive for gray iron and contains calcium, aluminum and silicon.

**GERMALLOY is a trademark for an additive for ductile and contains calcium, magnesium and silicon.

***MISHMETAL is a trademark for a general additive and contains 15% cerium and 50% lanthanum.

The body 468*b* forms a carrier tube for receiving the individual preweighed preprepared inoculant slugs 468*m* therein. The inoculant additive slugs 468*m* are cut from cylindrical rods having a diameter less than the diameter of the tube or body 468b or they can be individually cut so that they are readily received within the hollow interior thereof. Such slugs 468m can be readily counted and observed through the openings 468k. A steel butt cap 468n which has a cylindrical lower portion 468k, is frictionally received in the end of the tube or body 468b so as to close the upper end of the body 468b, is cone shaped and tapers upwardly, as indicated in numeral 468g. The nose or tip 468a is of a weight greater than the weight of cap 468n and tapers downwardly to a point, the upper or inner portion of the tip 468a being of reduced diameter and frictionally received in the lower end portion of the tube or body 468b, as indicated by numeral 468d. The tip 468a is preferably of steel.

Figure 11:
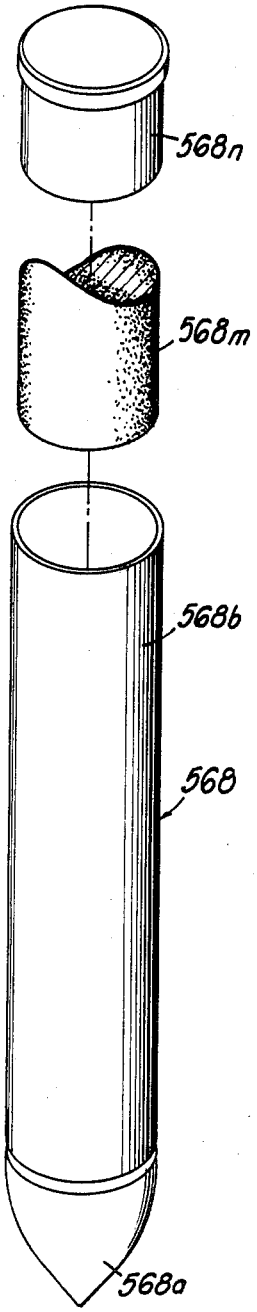
FIG. 11 is an alternate view of still another form of bullet which can be utilized in the apparatus depicted in FIG. 1.

In FIG. 11, it will be seen that a composite bullet 568 can be produced in which the body or tube 568b is a hollow cylindrical member formed of aluminum. This type of bullet carries a granular material such as ferro boron particles 568m fed therein. The cap 468n, which fits into the upper end of the body 568b, is frictionally held therein. Bullet 568 has convex surface which tapers to a point and a reduced diameter upper end received in the end of body 568b.

It will be observed in FIGS. 4, 5, 6, 7, 10 and 11 that the respective tips 68a, 168a, 268a, 368a, 468a and 568a are of larger diameter than the diameter of the body 68b, 168b, 268b, 368b, 468b, 568b to which it is affixed. The weight of the tips 68a, 168a, 268a, 368a, 468a, 568a, being greater than the body will tend to keep the bullet moving in a downward path. In addition to being heavier than the body, the tip will also be less readily rendered molten and thereby, it's momentum will cause the magnesium or boron body to be pulled along its path for a sufficient length of time that the body will become molten and any slugs, such as slugs, 468m will become molten. Thus, there is a distribution quite rapidly throughout a substantial portion of the molten metal 20, each time a bullet is shot into the molten metal.

The length of the magnesium bullets vary from 4" to 10", depending upon the capacity of the ladle. The 4" length of the magnesium bullet is used for 2,500 lbs. capacity ladle and the 10" length bullet for the 18,000 lbs. or higher capacity ladle.

The compressed air used for shooting has a pressure between 5.5 atmospheres and 7 atmospheres and is supplied from the main compressed air line of the foundry.

The velocity of the bullet in the air passing from the barrel 33 into the molten metal is approximately 43 meters per second. The penetration of the bullet having a 4' length magnesium body and a total weight of not less than 430 gms, in the molten metal in the ladle is 915 mm. For a bullet having a 10" length magnesium body and a total weight of not less than 430 gms, the penetration is 1,250 mm.

Generally, the penetration is dependent on the initial air pressure, geometry of the bullet and the weight of the bullet.

The carrier type bullet shown in FIG. 11 is loaded with 227 gms ferro-boron and has the same penetration. In this case the nose of the bullet is smaller but the total weight is the same.

Experiments with manufacturers white iron heats were carried out in the following way:

EXAMPLE I

The heat was topped in two ladles but only one ladle was treated by shooting magnesium bullets into the molten metal. Test bars were poured from each ladle, heat treated and tested together on a three point Tinius Olsen bending test machine. The tensil strength of the magnesium treated bar were approximately 16% higher than untreated test bars. In both cases, the hardnesses were in the range 500–580 HBN.

The fracture toughness valve for the magnesium treated white iron of Example I was 37.1 KSI$\times\sqrt{\text{in}}$ which is believed to be 33% higher than any valve which has been reported for prior art white iron. In addition, the magnesium treated white iron of Example I had an elongation of 1.4% which is believed to be higher than any elongation reported for prior art white iron. The pouring temperature was around 1,515° C. and the ladle was preheated to around 8,210° C.

The body of the bullet was about 120 gms of 100% pure magnesium and one bullet was used per 568 kgs of molten metal.

EXAMPLE II

The same type of experiment as specified in Example I was carried out using the same batch of NiHard 4 white iron and topping the molten metal into two ladles. The ladles, each contained 4,500 kgs of metal. One heat of molten metal was shot with six successive bullets of ferro-baron and then eight magnesium bullets. Each ferro-boron bullet contained 227 gms of ferro-boron (17% boron) and was of the type shown in FIG. 11. Each magnesium bullet contained 100% magnesium and was of the type shown in FIG. 5.

Test bars were made by pouring at about 1,114° C. and by heat treating these bars (oven cooled) under the same conditions. The ladles were preheated to about 821° C.

The average tensile strength of the boron, magnesium treated bars was 101,474.5 psi which was 31.36% higher than the tensile strength of the bars poured from the metal which was not treated with the bullets.

Figure 13:
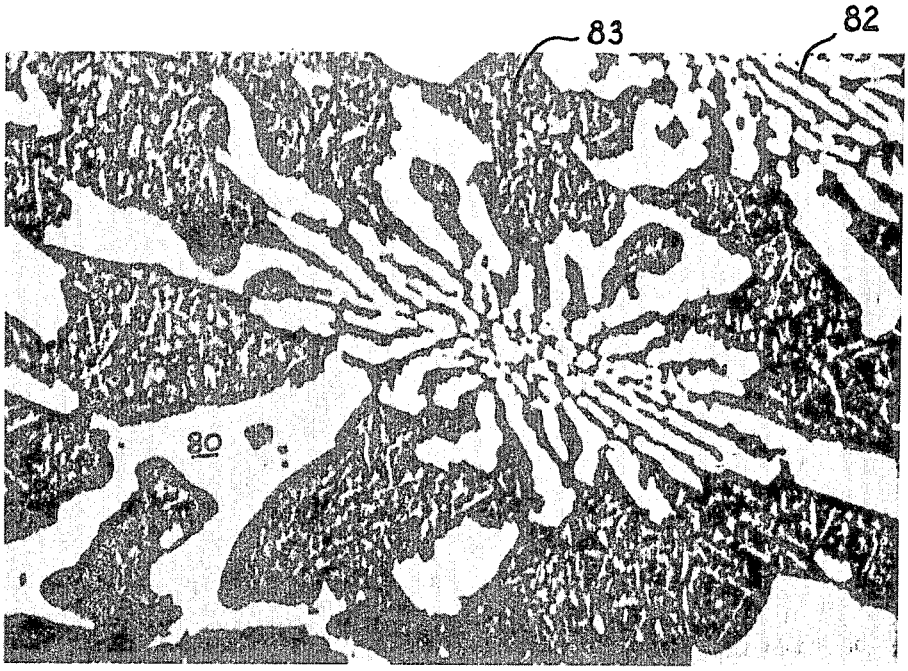
FIG. 13 is a micrograph of the same white iron (NiHard 4) as that of FIG. 12, but showing the effect of introducing the boron and magnesium into the molten metal using the process of the present invention.

FIG. 13 presents a heat treated microstructure of a NiHard 4 sample which was treated with magnesium and boron bullets in the fashion described in Example II, the microstructure being shown at 676 magnifications, the etching being accomplished by use of Fry's reagent.

Figure 12:
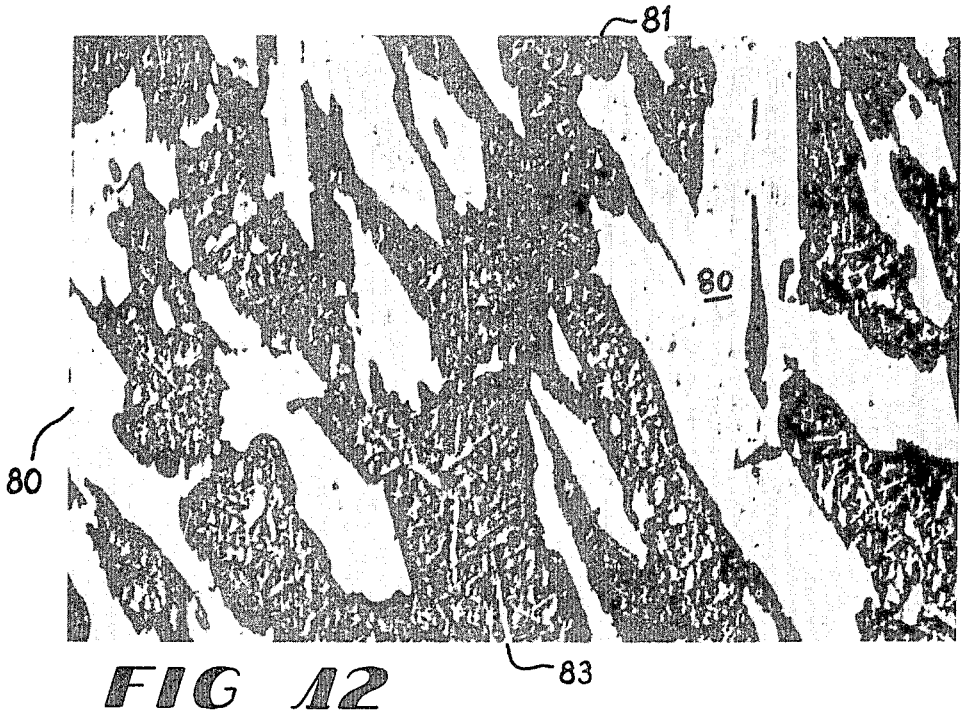
FIG. 12 is a micrograph showing the microstructive structure of prior art white iron (NiHard 4) which is produced using conventional procedures.

FIG. 12 presents a heat treated conventional microstructure of NiHard 4 at 676 magnifications and using Fry's reagent produced as described in Example II;

In FIGS. 12 and 13 named 80 indicates a primary chromium carbide, 81 the matrix, 82 a eutectic chromium carbide with boron and 83 the secondary carbides.

The improved carbide morphology of FIG. 13 (NiHard 4 with magnesium and boron bullets) is a result of the formation of eutectic carbides 82 and the smaller size of the primary chromium carbides 80.

With the heats as in Example II, cryogenic treated NiHard 4 test bars with boron and magnesium bullets had an average tensile strength of 91,969.75 psi which was 20.73% higher than the tensile strength of the test bars without bullets. The fracture toughness valve was 27.8 KSI$\times\sqrt{\text{in}}$ with a hardness of 616 HBN. This fracture toughness valve appears to be higher for NiHard 4 than any other fracture toughness valves reported by anyone.

EXAMPLE III

Magnesium bullet test bar was used to produce an 8630 grade steel. Tests were carried out at different laboratories and all the required physical or mechanical properties were fulfilled. Exceptional results presented the ROA (reduction in area) with an average result of 49% which is 40% higher than the requested 35% of the standard.

The pouring temperature was around 1,692° C. and the ladle was preheated to around 821° C.

In the above Examples I, II, and III, the heat loss of the metal in the ladle during the shooting operation was about 5.5° C. All of the ladles were tea-pot type with almost no slag at the surface. By using bottom pound ladle the heat lost was almost nil because the layer of slag at the surface had an insulating effect. When pouring white iron it was immaterial whether the ladle is lined with Alumina (80% $Al_2O_3$+20% $SiO_2$) or lined with silica. Steel was poured using only alumina (80%$Al_2O_3$+20% $SiO_2$) lined ladles.

When producing gray iron it is recommended that bullets similar to the bullet of FIG. 10 be used and that slugs of OPTIGRAM be employed in the amount of 0.025% wt. Gray iron treated with such bullets of OPTIGRAM develop an elongation of 1.5% when making additions of OPTIGRAM using prior art methods the gray iron develops an elongation of not greater than 0.8%.

When using my procedure for producing steel by in which from about 60% to pure magnesium is used in the bullets which are into the molten steel, the oxygen content can be quite readily dimished to about 1% ppm to about 24 ppm. At the same time, the hydrogen content of the steel drops to about 3 ppm to about 3.5 ppm.

I claim:

1. A bullet for use in injecting substances into molten metal comprising an elongated body and a nose affixed to one end of said body, said body containing a substance which will react in molten metal to form a reaction product, said reaction product being emmisible with said molten metal, said substance having an exterior which is continuously in an exposed condition to said molten metal so as to react with said molten metal throughout the period in which said body of said bullet is in remains contacted by but unreacted with said molten metal, and said nose being composed of a metal for alloying with said molten metal.

2. The bullet defined in claim 1 wherein said nose having a front end portion which tapers away from said body.

3. The bullet defined in claim 1 in which said body is cylindrical and said nose has a diameter larger than the diameter of said body, said nose and said body being concentric.

4. The bullet defined in claim 1 wherein said nose is tapered away from said body and wherein said nose is provided with lengthwise extending, sidewise opening, spaced grooves along the sides of said nose.

5. The bullet defined in claim 1 wherein said body is cylindrical and said nose is of a diameter larger than the diameter of said body wherein rear portion of said nose is recessed and received therein said one end of said body.

6. The bullet defined in claim 1 wherein said body is a hollow tubular member and said substance is disposed in said tubular member.

7. The bullet defined in claim 6 including a cap closing the rear end of said hollow tubular member.

8. The bullet defined in claim 6 wherein said hollow tubular member has circumferentially spaced tubular holes therein.

9. The bullet defined in claim 6 wherein said hollow tubular member has a hole in its side.

10. The bullet defined in claim 1 including means for affixing said nose to said body.

11. The bullet defined in claim 10 wherein said means includes a transverse pin passing through a portion of said nose and a portion of said body.

12. The bullet defined in claim 1 wherein said nose and said body are frictionally held together.

13. A bullet for use in injecting substances into molten metal comprising:

(a) an elongated body composed of a substance which reacts with said molten metal to form a reaction product and contains magnesium as an integral portion thereof; and (b) a nose having opposed ends and affixed by one of said ends to one end of said body, the other of said ends of said nose being tapered away from said body, the outer surface of said substance being on the exterior of said body so as to be contacted by said molten metal as said body is inserted nose first into and along a path of travel in said molten metal, whereby said substance progressively reacts with said molten metal as said bullet moves along its path of travel in said molten metal.

14. The bullet defined in claim 13 wherein said one end of said rod is imbedded in said nose and including a pin passing radially through said one end of said nose and through said one end of said rod.

15. The bullet defined in claim 13 wherein said nose is provided with circumferentially spaced radially extending outwardly opening grooves.

* * * * *